US011703807B2

(12) United States Patent
Nolan et al.

(10) Patent No.: US 11,703,807 B2
(45) Date of Patent: Jul. 18, 2023

(54) MAGNETICALLY COUPLED DEAD BEAT ESCAPEMENT BREAKAWAY MECHANISM

(71) Applicants: Kevin Farrelly Nolan, Louisville, KY (US); Jeremy Michael Turner, Taylorsville, KY (US); Stephen Bernard Froelicher, Shepherdsville, KY (US)

(72) Inventors: Kevin Farrelly Nolan, Louisville, KY (US); Jeremy Michael Turner, Taylorsville, KY (US); Stephen Bernard Froelicher, Shepherdsville, KY (US)

( * ) Notice: Subject to any disclaimer, the term of this patent is extended or adjusted under 35 U.S.C. 154(b) by 317 days.

(21) Appl. No.: 16/873,938

(22) Filed: Aug. 18, 2020

(65) Prior Publication Data

US 2022/0057756 A1 Feb. 24, 2022

(51) Int. Cl.

| | |
|---|---|
| ***G04C 5/00*** | (2006.01) |
| ***G04B 15/06*** | (2006.01) |
| ***G04B 15/14*** | (2006.01) |

(52) U.S. Cl.

CPC ..... *G04C 5/005* (2013.01); *G04B 15/06* (2013.01); *G04B 15/14* (2013.01)

(58) Field of Classification Search

CPC ..... G04C 5/005; G04B 15/06; G04B 15/14

See application file for complete search history.

(56) References Cited

U.S. PATENT DOCUMENTS

| | | | | |
|---|---|---|---|---|
| 4,378,166 | A * | 3/1983 | Itami | G04C 3/027 368/134 |
| 7,097,350 | B1 | 8/2006 | Conus et al. | |
| 9,627,952 | B2 * | 4/2017 | Schroeder | H02K 53/00 |
| 9,804,570 | B2 | 10/2017 | Winkler et al. | |
| 2007/0201317 | A1 * | 8/2007 | Houlon | G04C 5/005 368/281 |

FOREIGN PATENT DOCUMENTS

| | | |
|---|---|---|
| CH | 715356 A2 | 8/2020 |
| EP | 2911015 B1 | 8/2015 |

OTHER PUBLICATIONS

Derek Roberts, "Precision Pendulum Clocks, The Quest for Accurate Timekeeping", pp. 111-139 Schiffer Publishing Ltd., Alglen PA, USA, 2003.

* cited by examiner

*Primary Examiner* — Edwin A. Leon
*Assistant Examiner* — Kevin Andrew Johnston

(57) ABSTRACT

A dead-beat escapement break away assembly which consists of, a pallet engagement collet with at least one magnet attached thereto and a pallet alignment feature attached thereto; a pendulum crutch attachment mechanically coupled to the pallet engagement collet; a pallet which is adapted to be magnetically coupled to the pallet engagement collet so as to mechanically engage the pendulum crutch attachment to the pallet, thereby enabling the pallet to break away from the pallet engagement collet when sufficient force is applied to the pallet to overcome the magnetic force of the magnet.

19 Claims, 2 Drawing Sheets

MAGNETICALLY COUPLED DEAD BEAT ESCAPEMENT BREAKAWAY MECHANISM

FIELD OF THE INVENTION

The field of the invention is mechanical clock escapement mechanisms, and more specifically a break away mechanism for a dead beat escapement of a precision mechanical clock.

BACKGROUND OF THE INVENTION

Precision mechanically driven clocks have been around for a long time. As early as 1657 the first pendulum controlled clock was invented by Dutch scientist Christiaan Huygens. An important part of the precision clock is the regulator, which utilizes an escapement mechanism. The escapement mechanism controls the speed of rotation of the wheels in the time side of a clock and thus the hands connected to them. It consists of a balance or pendulum which every time it completes a swing releases one tooth of a wheel known as an escape wheel to rotate a set amount. At the same time the tooth imparts an impulse to the pendulum, which keeps it in motion. A dead beat escapement is an escapement wheel that does not recoil. As such, a precision clock may utilize a dead beat escapement to achieve the highest standard of precision and thus be capable of accurate timekeeping. An important element of the regulator is the escapement wheel which may have a plurality of delicate teeth that are mechanically engaged by a pallet. In the case of the dead beat escapement, there is the risk that the delicate teeth of the escape wheel may be damaged by the pallets should the train lose power. This can occur if the clock maintaining works fails to function or if the clock is allowed to run down. One can imagine the damage that could be caused to a delicate escape wheel by the tip of a pallet engaging the tip of a tooth under the momentum of the heavy pendulum bob. As such, it is desirable to have a mechanism to avoid damage to the escapement wheel teeth during these events.

BRIEF DESCRIPTION OF THE INVENTION

The present invention is a dead-beat escapement break away assembly which consists of, a pallet engagement collet with at least one magnet attached thereto and a pallet alignment feature attached thereto; a pendulum crutch attachment mechanically coupled to the pallet engagement collet; a pallet which is adapted to be magnetically coupled to the pallet engagement collet so as to mechanically engage the pendulum crutch attachment to the pallet, thereby enabling the pallet to break away from the pallet engagement collet when sufficient force is applied to the pallet to overcome the magnetic force of the magnet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
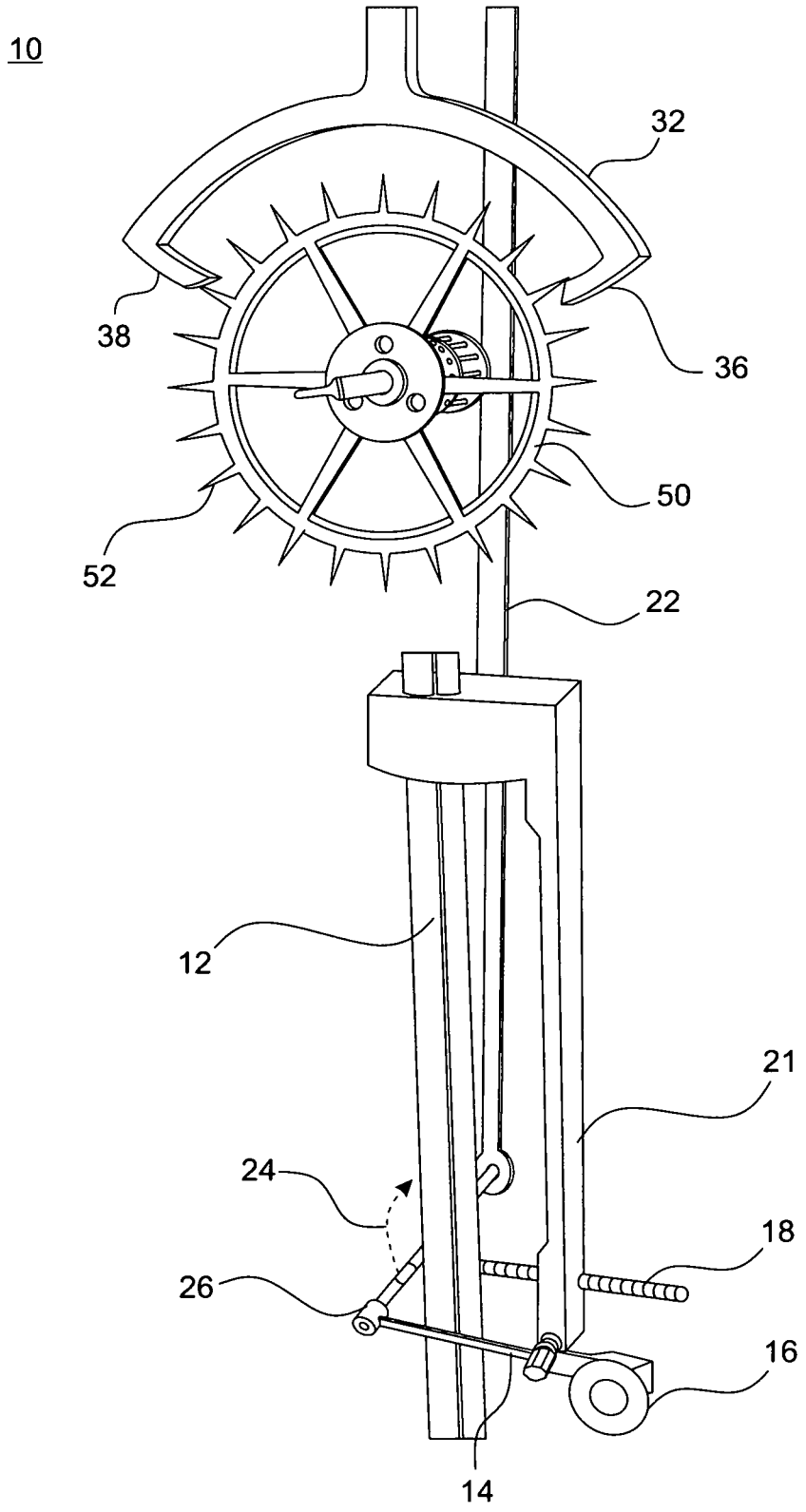
Figure 1 (Prior art)
FIG. 1 is an exemplary prior art break away clutch mechanism.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

There are many prior art break away assemblies in a precision mechanical clock. For example, a reference book was written by Derek Roberts, and published by Schiffer Publishing Ltd. in 2003, entitled, "Precision Pendulum Clocks, The Quest for Accurate Timekeeping", which book is hereby incorporated by reference into this Application. In Chapter 6 several types of escapements are described, including the dead-beat escapement by George Graham. In the Graham escapement mechanism, when the escapement wheel is rotated by the clock driving force which may be a weight or spring, a tooth of the pallet (called a pallet entry) only allows one tooth of the escapement wheel to advance at a time, just after this occurs the pallet exit tooth engages a separate tooth on the escapement wheel and the escapement wheel imparts a force onto the pallet that advances to pendulum. This combined action prevents the escapement wheel from moving in the reverse direction and keeps the pendulum in motion.

There have been may prior art mechanisms utilized to prevent damage to the escapement wheel tooth. For example, prior art systems have used spring loaded crutch pins or a break away arrangement. In the case of the former, the crutch pins are usually fitted to thin leaf springs which will yield if no more than the normal amount of pressure is brought to bear on them.

Figure 2:
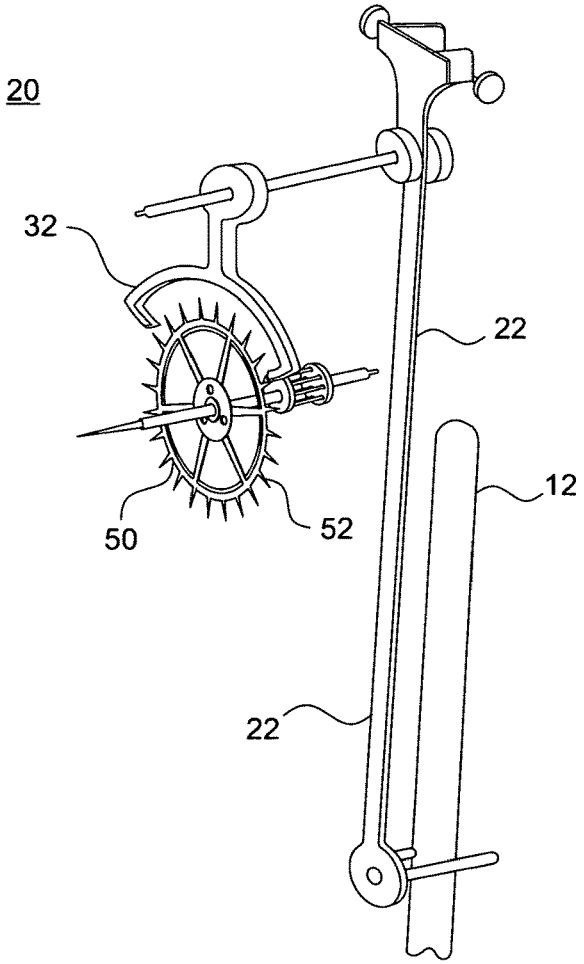
Figure 2 (Prior art)
FIG. 2 is an exemplary prior art dead beat assembly.

Another exemplary prior art break away arrangement 10 and 20 is depicted in FIGS. 1 and 2. In these illustrations, a pendulum rod 12 is mechanically coupled to a crutch 22, through a pivoted level 14 that employs a crutch holder 26 to hold the crutch in place by the force of a counter weight 16. The pivoted level 14 is held by a leaf spring 21 that is fixedly attached to the pendulum rod 12. During normal clock operation the pendulum 12 swings back and forth and because of the mechanical coupling to crutch 22 a mechanically coupled pallet enables operation of a dead beat escapement assembly. If for some reason the clock mechanism fails to function or the clock spring is allowed to run down the pallet may improperly engage the tooth 52 of the escapement wheel 50, thus causing a back force to be exerted on crutch 22 that is greater than the force of counter weight 16. This results in the pivoted level 14 to be disengaged from the crutch 22 and the associated pendulum rod 12, as the pivoted level arcs away in a semi-circular trough 24. This action protects the teeth of the escapement wheel 50.

Figure 3:
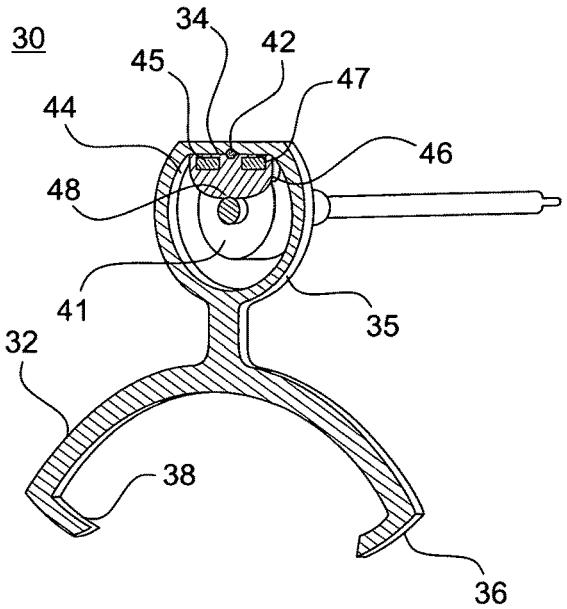
FIG. 3 is an illustration of the magnetic pallet and pendulum clutch attachment of the present invention which may be incorporated in the break away assembly of FIG. 2.

In the present invention 30, FIG. 3, the prior art break away arrangement is obviated. The present invention as illustrated in FIGS. 2 and 3, is a portion of a precision mechanical clock having a dead beat escapement break away assembly 20, which includes, a pendulum rod 12 which mechanically coupled to a crutch 22. The crutch 22 is mechanically coupled to a pendulum crutch attachment 41. Pendulum crutch attachment 41 includes a pallet engagement collet 48 which incorporates magnets 45 and 47 housed in magnet recesses 44 and 46 respectively, on either side of a pallet alignment feature 42. Pallet engagement collet 48 is designed to securely fit in the upper pallet engagement bracket 35 of the pallet 32. There is a pallet locking recess 34 that is designed to be fittingly engaged with the pallet alignment feature 42 of the pallet engagement collet 48. Pallet 32 may be made out of a magnetic steel and as such is attracted to the magnets 45 and 47, as such the pallet engagement collet 48 is mechanically coupled in a centering and secure fashion with the pallet 32 because of the alignment feature 42. The magnets may be neodymium N52 rare earth magnets, which may have a holding force of in a range from 0.3 to 1 pounds (lbs.). These magnets securely center and hold the collet 48 in place during normal operation of the clock. The holding force of the magnets is selected such that if pallet 32 improperly engages any one of a plurality of teeth 52 on the outer periphery of the escapement wheel 50 the collet is disengages from the pallet 32, thus avoiding damage to the escapement wheel teeth. After the misalignment is obviated, usually by normal movement of the escapement wheel, magnets 45 and 47 and the locking pin 42, without external manipulation or interference, automatically, reset, center and engage the pallet engagement bracket 35 onto the pallet engagement collet 48 so that normal operation of the escapement assembly can resume.

It is clear that the invention has been described in relation to a preferred embodiment of a break away dead beat escapement mechanism and that the invention can be applied to any other type of escapement without departing from the scope of the present invention defined by the annexed claims.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dead-beat escapement break-away assembly comprising:

a pallet engagement collet having at least one magnet attached thereto and having a pallet alignment feature attached thereto;

a pendulum crutch attachment mechanically coupled to said pallet engagement collet; and a pallet which is adapted to be magnetically coupled to said pallet engagement collet so as to mechanically engage said pendulum crutch attachment to said pallet, thereby enabling said pallet to break away from said pallet engagement collet when sufficient force is applied to said pallet to overcome the magnetic force of the at least one magnet.

2. The pallet engagement collet as recited in claim 1, having said pallet alignment feature that is adapted to engage with a pallet locking recess to center said pallet engagement collet on said pallet.

3. The pallet engagement collet as recited in claim 2 further having two magnets on opposing sides of said pallet alignment feature.

4. The pallet engagement collet as recited in claim 1, wherein said at least one magnet is a rare earth magnet.

5. The pallet engagement collet as recited in claim 4, wherein said rare earth magnet is selected from the list consisting consists of at least one neodymium magnets.

6. The pallet engagement collet as recited in claim 1, wherein each said at least one magnet has a magnetic force in a range from 0.3 to 1.0 lbs.

7. The escapement break-away assembly as recited in claim 1, further comprising an escapement wheel having a plurality of teeth along its outer circumference.

8. The pallet engagement collet as recited in claim 7, wherein the magnetic force is sufficient to cause a break away to avoid damage to any one of said plurality of teeth on said escapement wheel.

9. A method of breaking away in a dead-beat escapement assembly of a clock, having a pallet escapement collet, and having an escapement wheel with teeth, and having a pallet, comprising:

breaking away said pallet engagement collet from said pallet which is magnetically coupled to said pallet engagement collet when sufficient force is applied to said pallet to overcome the magnetic force, which force is greater than the force necessary to enable normal operation of the break away assembly of a clock.

10. The method of breaking away as recited in claim 9, wherein said magnet force is selected to avoid damage to said teeth of said escapement wheel.

11. The method of breaking away, as recited in claim 10, wherein said magnetic force is in a range from 0.3 to 1.0 lbs.

12. A mechanical clock having a dead-beat escapement break away assembly comprising:

a pendulum mechanically coupled to said dead beat escapement assembly;

a crutch mechanically coupled to said pendulum;

a crutch assembly mechanically coupled to said crutch;

a pendulum crutch attachment having a pallet engagement collet mechanically coupled to said crutch assembly;

said pallet engagement collet having at least one magnet attached thereto and having a pallet alignment feature thereto;

a pallet which is adapted to be magnetically coupled to said pallet engagement collet so as to mechanically engage said pendulum crutch attachment to said pallet, thereby enabling said pallet to overcome the magnetic force of the at least one magnet.

13. The pallet engagement collet as recited in claim 12, having said pallet alignment feature that is adapted to engage with said pallet locking recess to center said pallet engagement collet on said pallet.

14. The pallet engagement collet as recited in claim 13 further having two magnets on opposing sides of said pallet alignment feature.

15. The pallet engagement collet as recited in claim 12, wherein the at least one magnet is a rare earth magnet.

16. The pallet engagement collet as recited in claim 15, wherein the rare earth magnet consists of at least one neodymium magnets.

17. The pallet engagement collet as recited in claim 16, wherein each of the at least one magnets has a magnetic force in a range from 0.3 to 1.0 lbs.

18. The escapement break away assembly, as recited in claim 12, further comprising an escapement wheel having a plurality of teeth along its outer circumference.

19. The pallet engagement collet as recited in claim 18, wherein the magnetic force is sufficient to cause a break away to avoid damage to any one of said plurality of teeth on said escapement wheel.

* * * * *